United States Patent [19]

Ferguson et al.

[11] 4,198,733

[45] Apr. 22, 1980

[54] FABRIC COVERED BUTTON

[75] Inventors: Bruce A. Ferguson, Hinsdale; Leo D. Ptasinski, Chicago; Harvey E. Schulz, Hillside, all of Ill.

[73] Assignee: The Maxant Corporation, Chicago, Ill.

[21] Appl. No.: 943,999

[22] Filed: Sep. 20, 1978

[51] Int. Cl.[2] ..... A44B 1/12

[52] U.S. Cl. ..... 24/113 R; 24/92

[58] Field of Search ..... 24/113 R, 113 MP, 90 A, 24/90 B, 92

[56] References Cited

U.S. PATENT DOCUMENTS

| | | | |
|---|---|---|---|
| 2,128,095 | 8/1938 | Levy | 24/113 MP |
| 2,301,049 | 11/1942 | Kaynor et al. | 24/113 MP X |
| 2,685,722 | 8/1954 | Danco, Jr. | 24/113 R |
| 2,799,908 | 7/1957 | Morin | 24/113 R |
| 2,977,653 | 4/1961 | Adinolfi | 24/113 R |
| 3,500,506 | 3/1970 | Mitchell | 24/113 R |
| 4,012,812 | 3/1977 | Black | 24/113 R X |

*Primary Examiner*—Philip C. Kannan

*Attorney, Agent, or Firm*—Jakala, Knechtel, Valentino, Demeur & Dallas

[57] ABSTRACT

A fabric covered button of two-piece construction includes a button portion and a collet retainer. The button portion consists of a button head and a stem integrally formed with the underside of the button head. The backside of the button head is provided with an annular recessed cavity about the stem. The collet retainer and the peripheral edge of the fabric are substantially completely disposed within the recessed cavity. The collet retainer is of circular shape with a side wall and a concave top wall with a central hole to receive the stem of the button head.

5 Claims, 3 Drawing Figures

FABRIC COVERED BUTTON

This invention relates to improvements in fabric covered buttons and to the method for fabricating them.

Buttons of the type with which the invention is concerned, i.e., fabric covered buttons, are well-known and have been in use for many years. Such buttons have been and are used in a variety of different applications, two of the principal ones of which are probably dressmaking and upholstering. The buttons are generally covered with a fabric or other material which matches the particular garment or article such as an upholstered chair or sofa. Buttons of this type are disclosed in at least the following U.S. Pat. Nos. namely, 174,161; 202,907; 1,164,460; 2,649,634; 2,716,794; 3,425,101; and 3,934,314.

The existing fabric covered buttons all generally comprise a stamped metal shell which is formed to receive on the back side thereof a stamped metal disc. In assembling the buttons, the fabric is draped or wrapped over and around the sides of the shell, and then the disc is forcibly or otherwise urged into the back side of the shell so as to captivate the fabric between the interior periphery of the shell and the outer diameter of the disc. The disc is sometimes provided with prongs or the like to more securely retain the fabric about the shell and to secure the disc and the shell together as an assembly.

While these fabric covered buttons have been used for many years, and have been substantially improved upon over the years, most of them are objectionable for one reason or another, and all of them are objectionable in that in too many cases, the disc becomes separated from the shell, thus permitting the fabric to become separated from the button. In many cases, the disc, as well as functioning to complete the assembly of the button and to contain the fabric about the shell, also is formed or provided with securement means for fastening the buttons to a garment or an article. In such cases, the various forces and stresses exerted upon the button pull or otherwise disengage the disc from the shell so that only the disc remains attached while the shell and the fabric covering are lost. This deleterious result has, to some extent, been overcome by, in some constructions, affixing the securement means to the shell and then adapting the disc to receive therethrough the securement means so that the latter then can be used to affix the button to a garment or an article. However, such constructions do not fully overcome the problem, for the fabric still is secured about the shell by means of the disc and the disc still, in too many cases, becomes dislodged so that the fabric becomes loose or lost.

In most cases, the shells and the discs are stamped from a thin metal and the securement means are wire loops or the like secured in some fashion, e.g., by welding, to either the disc or the shell. In those constructions where the wire securement means is affixed to the shell, the front exposed face of the shell, once the fabric is lost, usually is marred or otherwise disfigured so that the bare shell is generally unsightly to an observer and ruins the appearance of the garment or article.

While, as indicated above, substantial improvements have been made to the construction of these fabric covered buttons, in an attempt to overcome various objectionable features associated with it, each improvement generally has increased the cost of material or manufacture and assembly, or both.

A factor which must be taken into consideration in the design of any new button of this type is the fact that most garment, upholstery and other manufacturers who utilize these buttons do not make them, but purchase them from button manufacturers. In addition, these users many times do not assemble these buttons, i.e., place the fabric on them, but instead, simply supply the fabric and have the assembly done by others. The larger users may assemble the buttons themselves. In any case, the buttons are generally assembled using dies or tools specifically designed for this purpose, thus the adoption of any new button construction normally likewise requires the purchase of new dies or tools.

Another factor which also must be taken into consideration is that the components or button parts from which the fabric covered buttons are formed are sold, usually in kits, to housewives, amateur dressmakers and the like, who form or assemble their own fabric covered buttons. The components or button parts therefor should be of a construction which permits the utilization thereof in such kits.

The fabric covered button of the present invention or, more particularly, the components or button parts which are used in forming or assembling a fabric covered button is of a two-piece construction and includes a button portion which advantageously can have any one of a number of different types of securement means integrally or otherwise formed with it, and a collet retainer. The button portion consists of a button head having a stem integrally formed with the underside of the button head. Any one of a number of different attachment means are or can be integrally formed with the stem, at the terminal end thereof. The terminal end of the stem about its diameter preferably and advantageously is formed with a tapered camming surface, for assisting in initially affixing the collet retainer to the stem, as more particularly described below. Also, the back side of the button head preferably and advantageously is formed with an annular recessed cavity about the stem. The depth and diameter of the recessed cavity preferably and advantageously is such that the collet retainer can be received within it, together with the peripheral edge of the fabric, such that the collet retainer is substantially or completely disposed within the recessed cavity so as to substantially conceal it.

The collet retainer preferably and advantageously is stamped from sheet metal, and is of a circular shape with a side wall and a top wall. The top wall is concave and has a central hole which can receive the stem of the button head. The peripheral portion of the top wall of the collet retainer adjacent the central hole is angularly bent downwardly at a relatively sharper angle than the remainder of the top wall to form a camming surface which is engageable by the stem, or the camming surface provided on the terminal end of the stem. The diameter of the central hole is smaller than the diameter of the stem, preferably and advantageously at least several thousandths smaller than the diameter of the stem.

The collet retainer is secured to the stem by forcibly urging the stem through the central hole. In doing so, the camming surface on the collet retainer initially engages the terminal end of the stem, or the camming surface thereon, and as it is forced onto the stem, the top wall of the collet retainer is caused to flex outwardly sufficiently to receive the stem through the central hole and to permit the edge of the central hole about its diameter to frictionally engage the stem as the collet retainer is forcibly urged upwardly on the stem. Prior to affixing the collet retainer to the stem of the button head, the fabric, of course, is draped about the button head and extended around its edges to the rear thereof. The collet retainer is forcibly urged upwardly on the stem until it captivates the edges of the fabric between it and the back side of the button head. When the upward force urging the collet retainer upwardly on the stem is released, the top wall flexes inwardly sufficiently to cause the edge of the central hole about its diameter to effectively bite into the stem, to lockingly secure the collet retainer to the stem. The recessed cavity in the back side of the button head and the manner in which the collet retainer is lockingly secured to the stem both function in conjunction with one another to compensate for fabrics of different weights, as more particularly described below.

The button head preferably and advantageously is molded of plastic, although other materials can be used. The button heads can be molded in different colors so that the button heads can be selected to coordinate with the color of the fabric. By doing so, in the event that the garment and/or the fabric covered buttons are subjected to abuse or unusual wear which results in the inadvertent loss of the fabric covering, the button head will blend with the fabric and will not stand out in contrast with the fabric, as in the case of existing stamped metal button shells and/or the stamped metal disc. The button head also can be textured to add a decorative finish, as well as color, to the exposed button head.

Accordingly, it is an object of the present invention to provide improvements in fabric covered buttons and, more particularly, improvements to and in the method for fabricating them.

The invention and the preferred features thereof outlined above will now be described in greater detail, with reference to the accompanying drawings in which.

DESCRIPTION OF THE PREFERRED EMBODIMENT

Figure 1:
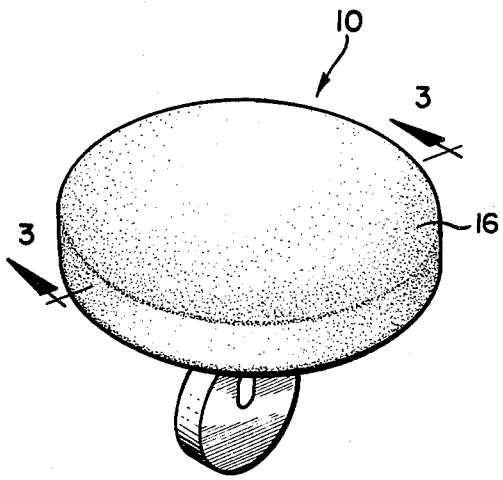
FIG. 1 is a perspective view of a button exemplary of the present invention.

Referring now to the drawings, in FIG. 1 there is illustrated a fabric covered button 10 which in accordance with the invention, includes components or button parts which are used in forming or assembling it. These components or button parts, as can be best seen in FIGS. 1 and 3, include a button portion 12 and a collet retainer 18 which functions to secure the fabric 16 to the button 10, all as more fully described below.

Figure 2:
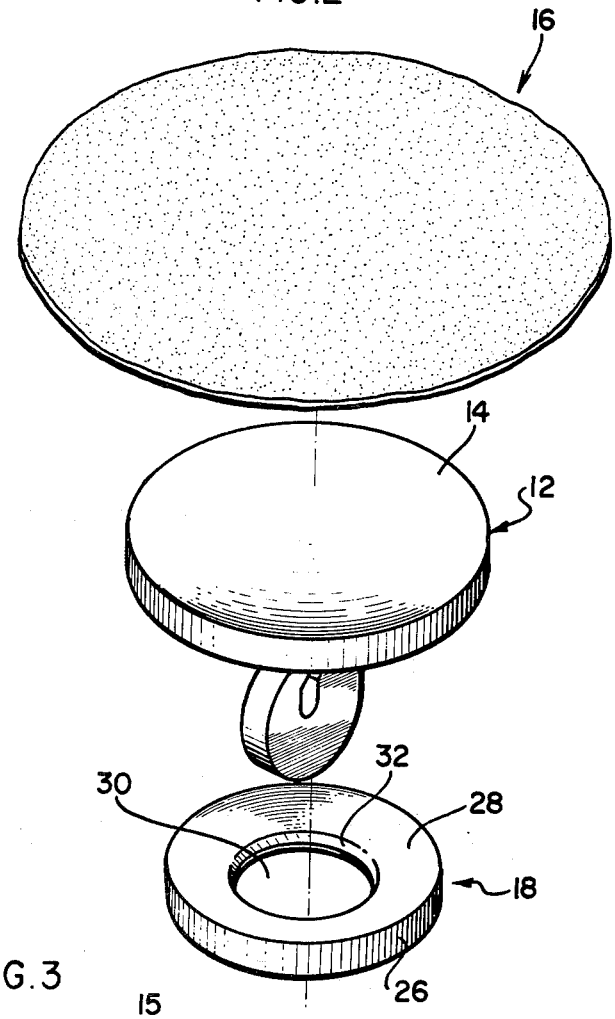
FIG. 2 is an exploded perspective view of the button of FIG. 1.
Figure 3:
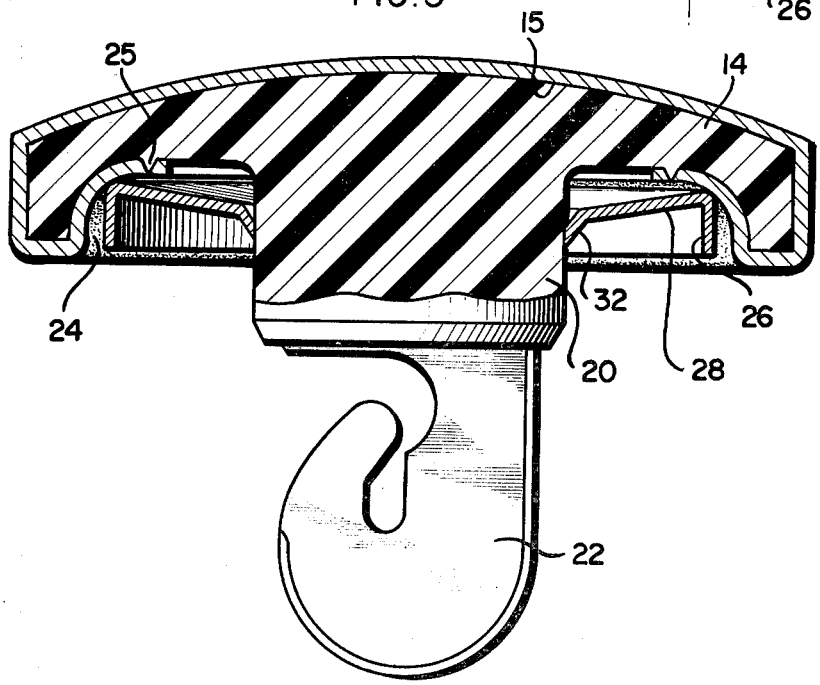
FIG. 3 is a sectional view of the fabric covered button of FIG. 1, illustrating the manner in which it is assembled.

As can be best seen in FIGS. 2 and 3, the button portion 12 includes a button head 14 which has a convex head portion 15 on the upper end thereof and a stem 20 on the underside thereof. Attachment means 22, such as the hook illustrated, is integrally formed with the terminal end of the stem 20. Various other attachment means 22 likewise can be integrally formed with the stem 20, depending upon the particular application for the fabric covered button 10.

The back side of the button head 14 is formed with a recessed cavity 24 about the stem 20 and, as can be best seen in FIG. 3, this recessed cavity 24 is of a depth and a diameter such that the collet retainer 18 can be received within it, as more particularly described below.

The collet retainer 18, as can be best seen in FIGS. 2 and 3, is circular shaped and has a side wall 26 and a top wall 28. The collet retainer 18 preferably and advantageously is stamped from sheet metal. The top wall 28 of the collet retainer 18 preferably and advantageously is dish shaped or concave, and has a central hole 30 formed in it for receiving therethrough the stem 20 of the button head 12. Also, as can be best seen in FIG. 3, the peripheral portion of the top wall 28 adjacent the central hole 30 is annularly bent downwardly at a relatively sharper angle than the remainder of the top wall 28 to form a camming surface 32. The diameter of the central hole 30 is smaller than the diameter of the stem 20, preferably by at least several thousandths of an inch, for reasons set forth more specifically below.

In assembling the fabric covered button 10, the fabric 16 is draped over the button head 14 and extended around its edge to the rear thereof, as can be best seen in FIG. 3. The collet retainer 18 then is forcibly urged upwardly on the stem 20 and, in doing so, the camming surface 32 on the collet retainer engages with the camming surface 21 on the stem 20 and as the collet retainer is forcibly urged upwardly, the top wall 28 of the collet retainer is flexed outwardly sufficiently to receive the stem 20 through the central hole 30. As the collet retainer 18 is forcibly urged upwardly, the edge of the central hole 30 about its diameter frictionally and slidably engages the stem as it is pushed upwardly. The collet retainer 18, obviously, is pushed upwardly on the stem 20 until it engages and secures the edge of the fabric 16, between it and the rear of the button head 14, as can be best seen in FIG. 3. When in place and the upward force urging the collet retainer upwardly on the stem 20 is released, the top wall 28 of the collet retainer 18 flexes inwardly, i.e., it attempts to return to its original shape, sufficiently to cause the edge of the central hole 30 about its diameter to effectively bite into the stem 20, to lockingly secure the collet retainer 18 to the stem 20.

As can be best seen in FIG. 3, the collet retainer 18 and the edge of the fabric 16 both are received and disposed within the recessed cavity 24 on the rear of the button head 12, so that the collet retainer 18 is substantially concealed within the recessed cavity 24. Also, since the collet retainer 18 can be positionally locked in position anywhere along the length of the stem 20, different weight fabrics are easily compensated for since it is only necessary to have the collet retainer 18 engage the edges of the fabric 16 to secure the fabric to the button head. Also, the depth of the recessed cavity 24 is such that the collet retainer 18 can be effectively concealed within the recessed cavity 24 even when heavy weight fabrics are utilized.

It will thus be seen that the objects set forth above, among those made apparent from the preceding description, are efficiently attained, and certain changes may be made in the above article. Accordingly, it is intended that all matter contained in the above description, or shown in the accompanying drawings, shall be interpreted as illustrative and not in a limiting sense.

Now that the invention has been described, what is claimed as new and desired to be secured by Letters Patent is:

1. A fabric covered button comprising a button portion in the form of a button head having on the rear face thereof a cylindrical-shaped stem of a diameter smaller than said button head and attachment means for securing said fabric covered button head and attachment means for securing said fabric covered button to an article integrally formed with the terminal end of said stem; a piece of fabric draped over said button head and extended around its edge to the rear thereof; and a circular-shaped collet retainer secured about said stem having a concave-shaped top wall and an annular depending side wall, the edges of said fabric at the rear of said button head being secured between the rear of said button head and the peripheral edge of said top wall of said collet retainer, said side wall of said collet retainer extending away from said button head, whereby the terminal edges of said side wall are prevented from cutting said fabric, said top wall having a central hole which can receive said stem, the peripheral portion of said top wall adjacent said central hole being angularly bent downwardly at a relatively sharper angle than the remainder of said top wall to form a camming surface which is engageable by said stem, the diameter of said central hole being smaller than the diameter of said stem, said collet retainer being secured to said stem with said side wall extending away from said rear face of said button head by forcibly urging said stem through said central hole by engaging said camming surface such that said top wall flexes outwardly sufficiently to receive said stem through said central hole and to permit the edge of said central hole about its diameter to frictionally engage said stem as said collet retainer is forcibly urged upwardly on said stem, said collet retainer being securely locked to said stem when the force urging said collet retainer upwardly on said stem is released permitting said top wall to flex inwardly sufficiently to cause the edge of said central hole about its diameter to effectively bite into said stem.

2. The fabric covered button of claim 1, said button head on the rear face thereof having an annular recessed cavity about said stem, the depth and diameter of said cavity being such that said collet retainer can be received within it, the edges of said fabric being disposed within said cavity and secured therein by said collet retainer.

3. The fabric covered button of claim 2, wherein the depth of said recessed cavity and the method in which its collet retainer is lockingly secured to said stem compensating for fabrics of different weights.

4. The fabric covered button of claim 1, wherein said button portion is integrally molded of plastic and said collet retainer is a metal stamping.

5. The fabric covered button of claim 1, wherein the terminal end of said stem about its periphery is formed with a tapered camming surface, for assisting in assembling said collet retainer on said stem.

* * * * *